US005313683A

United States Patent [19]

Dickie et al.

[11] Patent Number: 5,313,683

[45] Date of Patent: May 24, 1994

[54] HOUSEHOLD CLEANING IMPLEMENT

[75] Inventors: Robert G. Dickie, Newmarket; Maurice Tousson, Thornhill; William A. Edgar, Claremont; Peter Jennings, Toronto, all of Canada

[73] Assignee: Maubiter Trading Inc., Toronto, Canada

[21] Appl. No.: 908,076

[22] Filed: Jul. 6, 1992

[51] Int. Cl.[5] ..... A47L 1/08

[52] U.S. Cl. ..... 15/117; 15/105; 15/106; 15/257.2

[58] Field of Search ..... 15/105, 106, 117, 257.2

[56] References Cited

U.S. PATENT DOCUMENTS

| | | | |
|---|---|---|---|
| 834,770 | 10/1930 | Steele | 15/257.3 |
| 2,172,808 | 9/1939 | Roy | 15/257.2 |
| 2,896,241 | 7/1959 | Cotman | 15/111 X |
| 2,908,929 | 10/1059 | Cotman | 15/111 X |
| 3,110,052 | 11/1963 | Whitman | 15/117 |
| 3,968,535 | 7/1976 | Nichols | 15/114 X |
| 4,281,433 | 8/1981 | Sendoykas | 15/114 X |
| 4,809,386 | 3/1989 | Re | 15/114 X |
| 4,922,569 | 5/1990 | Brinker et al. | 15/117 X |

*Primary Examiner*—Chris K. Moore
*Attorney, Agent, or Firm*—Donald E. Hewson

[57] ABSTRACT

A device for effecting general household cleaning comprises a main body member having a first longitudinal axis, with a portion of said main body member having a generally hollow handle portion defining a storage area. A head member is affixed to a first end of the main body member, and it has a second longitudinal axis. There is a brush at a second end of the main body portion, having an elongated spine and a plurality of bristles securely retained by the spine. The brush is connected in movable relation to the main body member, and is movable between an extended position and a retracted position. A sponge is securely retained on the head portion; and a resilient blade is also securely retained on the head portion and is adapted for wiping liquid from a surface. There is also a retaining member adapted for releasable attachment to the head member and further adapted to securely retain the sponge and the blade on the head member. Thus, the head and the retaining member are generally elongated and have opposed receiving surfaces adapted to receive and retain a portion of the sponge and the blade therebetween. The device further comprises a debris collection pan removable attached thereto by a further handle portion that clips onto the handle of the main body portion. The pan has a filtered spout, so liquids and solids collected in the pan may be separated by pouring off the liquid.

7 Claims, 5 Drawing Sheets

HOUSEHOLD CLEANING IMPLEMENT

FIELD OF THE INVENTION

This invention relates to implements used for cleaning, and more particularly to devices that combine a plurality of such implements used for general household cleaning and the like.

BACKGROUND OF THE INVENTION

Many forms of brushes, sponges, wipers, dustpans and the like, are well know for use in general household cleaning of dirt, debris, spills or similar. Such cleaning may involve washing windows, floors and so on, sweeping up loose debris such as garbage, broken glass and so on, sweeping up dirt, dust, grit and the like, and several other related tasks. Very often, these tasks are all performed together so as to effect the complete cleaning of a room or entire home. It is therefore desirable to have several implements that might be used performing these cleaning tasks all readily available without having to locate each separate implement. It is also desirable to make it easy to transport the implements while moving from place to place during cleaning. Particularly, and in any event, when some quick cleaning chores are to be undertaken, it is desirable to have the common implements that are necessary to effect the cleaning chores, both readily available in one location and easily transportable.

It is also desirable to have a such implements fit into a reasonably compact volume so as to not take up any more storage space than is necessary.

Further, many household implements have parts that are worn or damaged on a regular basis, such as sponges, wiper blades, brushes and the like, which therefore require regular replacement. Very often such replacement is not possible and a whole new implement must be obtained. If it is possible to replace various parts as desired, then such replacement is frequently difficult and may require the use of special purpose or general household tools.

It is also a common problem when effecting household cleaning, to collect various kinds of household debris in a dustpan. Often, it is necessary to subsequently deposit some of the debris in one location and other of the debris in another location. This can be exemplified by the cleaning up of a glass of water that has been dropped and broken. In brushing up the glass into a pan, it may be desirable to collect the water in the pan also—which indeed may be inevitable to some degree—and this creates a subsequent problem of separating the water from the glass since it is not desirable to deposit the water in a garbage container in which the glass might be deposited. Further, it is not possible to dispose of glass into a sink where water would normally be poured. Disposal of two such different types of debris collected in a common dust pan is typically somewhat difficult.

It is an object of the present invention to provide a multi-implement device for use in effecting general household cleaning.

It is another object of the present invention to provide a multi-implement device for use in effecting general household cleaning, where the multi-implement device is compact and easy to store.

A further object of the present invention is to provide a multi-implement device for use in effecting general household cleaning that allows for positive, easy and clean replacement of the various implements of the multi-implement device.

It is yet a further object of the present invention to provide a multi-implement device for use in effecting general household cleaning that can allow for liquids and solids that have been collected, to be separately disposed of.

A still further object of the present invention is to provide a multi-implement device for use in effecting general household cleaning that is formable entirely from plastic, and is therefore entirely recyclable.

SUMMARY OF THE INVENTION

A multi-implement device for effecting general household cleaning is disclosed. The multi-implement device comprises a main body member having a first longitudinal axis therealong, with a portion of the main body member having a generally hollow handle portion defining a storage area therein. A head member is affixed to a first end of the main body member, the head member having a second longitudinal axis. A brush having an elongated spine and a plurality of bristles securely retained by the spine is connected in movable relation to the main body member and is movable between an extended position and a retracted position. There is a sponge and a resilient blade, each of which is securely retained on the head member. The blade is adapted for wiping liquid from a surface. A retaining member is adapted for releasable attachment to the head member and is further adapted to securely retain the sponge and the blade on the head member, with the head and retaining member being generally elongated and having opposed receiving surfaces adapted to receive and retain a portion of the sponge and the blade therebetween.

The second longitudinal axis of the head member is perpendicular to the first longitudinal axis of the body member. The brush is pivotably mounted by means of a pivot member having a pivot axis that is perpendicular to the first longitudinal axis and which is parallel to the second longitudinal axis, with the brush being arcuately movable in a plane generally perpendicular to the pivot axis.

The retaining member is secured to the head member by at least one clip located on the retaining member.

There is also a debris collecting pan removably attached thereto. The debris collecting pan has a debris receiving portion, first and second side walls, a back wall, a leading edge portion, and a handle portion. The handle portion of the debris collecting pan is adapted so as to clip onto the hollow handle portion of the main body member.

BRIEF DESCRIPTION OF THE DRAWINGS

Embodiments of this invention will now be described by way of example, and with reference to the accompanying drawings, in which.

DETAILED DESCRIPTION OF THE PREFERRED EMBODIMENTS

Figure 1:
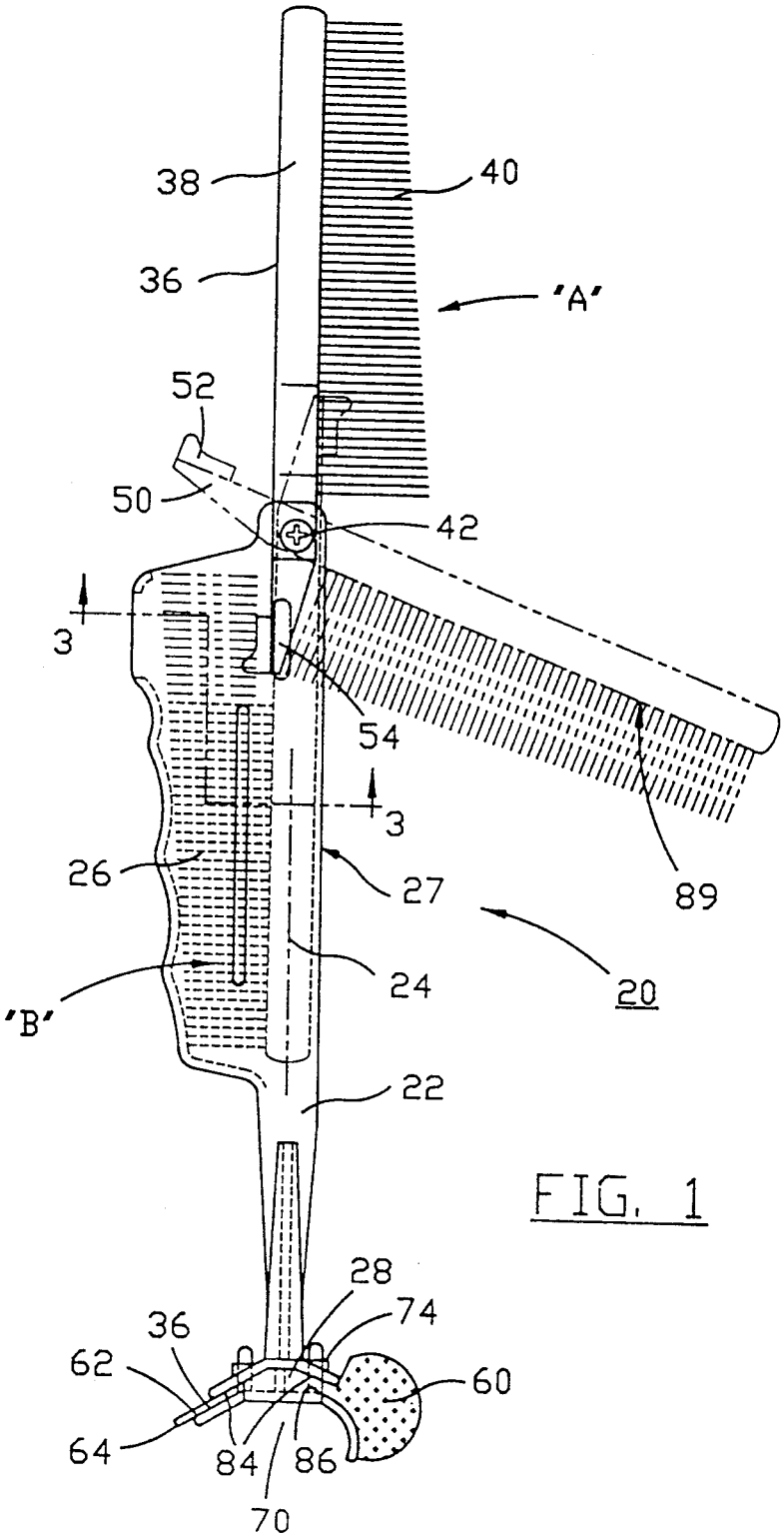
FIG. 1 is a side view of the multi-implement device of the present invention.
Figure 2:
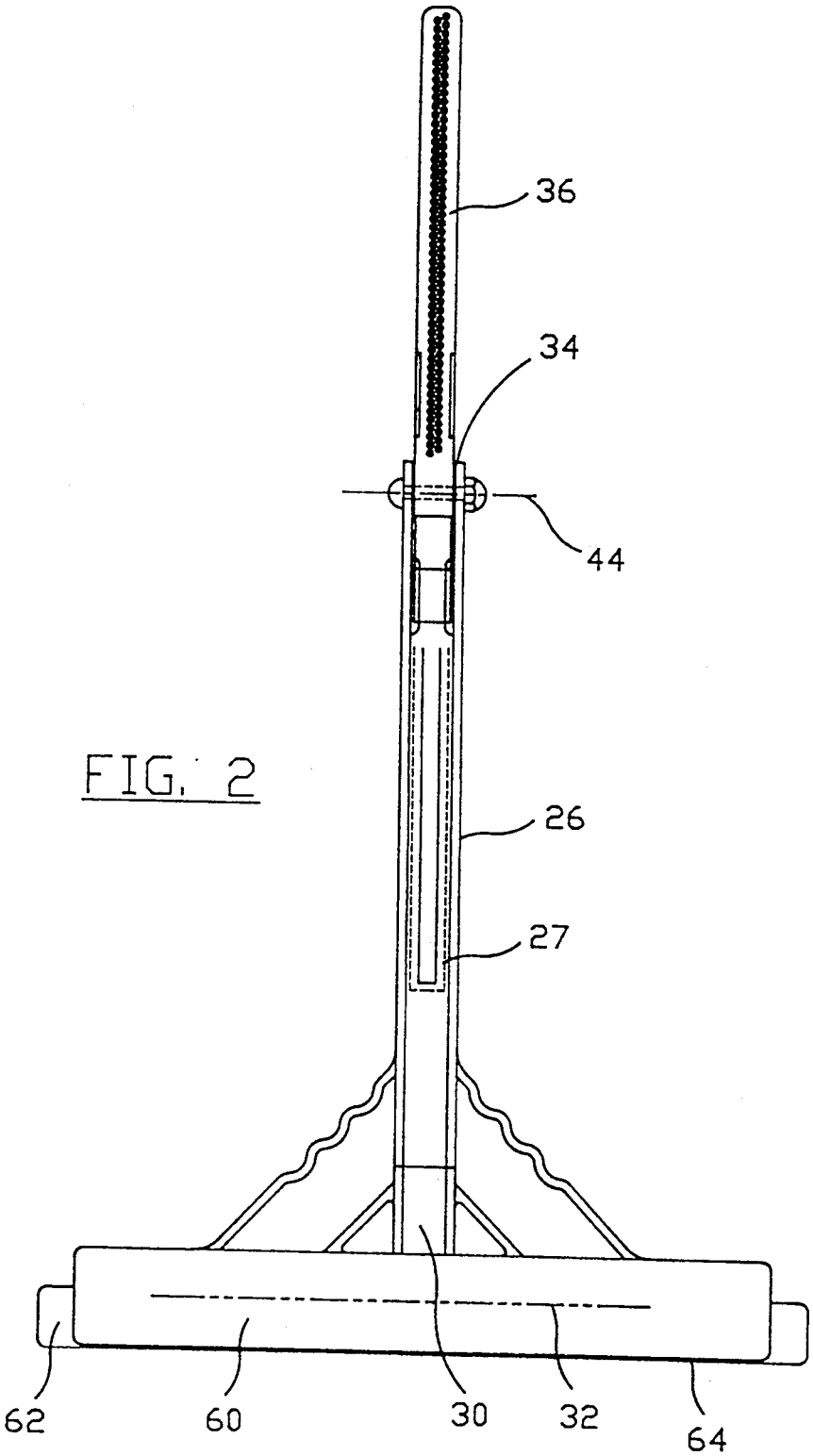
FIG. 2 is a bottom view of the multi-implement device as shown in FIG. 1.

Reference will now be made to FIGS. 1 through 6, which show the multi-implement device 20 of the present invention that is to be used to effect general household cleaning. The multi-implement device 20 has a main body member 22 having a generally centrally disposed first longitudinal axis 24 that is aligned along the length of the main body member 22. A portion of the main body member 22 is a generally hollow handle portion 26 with an opening 27 in the bottom thereof. The generally hollow handle portion 26 defines a storage area therein.

The multi-implement device 20 also has a head member 28 attached to the first end 30 of the main body member 22. The head member 28 has a generally centrally disposed second longitudinal axis 32 that is aligned along the length of the head member 28. The second longitudinal axis 32 of the head member 28 is also perpendicular to the first longitudinal axis 24 of the main body member 22.

At the second end 34 of the main body member 22 there is a brush 36 having an elongated spine 38 and a plurality of bristles 40 securely retained by the spine 38. The brush 36 is connected in pivotal relation to the main body member 22 and moves between an extended "A" and a retracted position "B". In the retracted position the brush is retained within the storage area of the hollow handle portion 26 which is accessible through opening 27. In its extended position, the brush 36 is in place for use to sweep debris and the like. The brush 36 is pivotably mounted by means of a pivot member 42 that has a pivot axis 44 that is perpendicular to the first longitudinal axis 24 and which is parallel to the second longitudinal axis 32. The pivot member 42 is preferably a high quality plastic bolt and nut arrangement; but it may also be such as a chrome-plastic bolt and cap nut. The brush 36 moves arcuately in a plane that is generally perpendicular to the pivot axis and substantially coplanar with the first longitudinal axis 24.

On one end 50 of the brush 36 there is a stop member 52 that contacts a stop means 54 on the main body member 22. The arcuate motion of the brush 36 is limited by the stop means 52. Preferably, the one end 50 is a longitudinal extension of the spine 38 and is disposed on the opposite side of the pivot axis 44 to the bristles 40.

There is a sponge 60 and a resilient blade 62 each of which is securely retained on the head member 28. The sponge is typical of the type to be used for washing windows and the like. The resilient blade 62 functions as a squeegee that is typically used to wipe liquid from a surface, commonly a flat surface such as a window. The resilient blade 62 has a generally straight edge 64 and is generally planar. The resilient blade 62 is preferable made of rubber, or a synthetic rubber-like material, so as to be soft and pliable.

Figure 5:
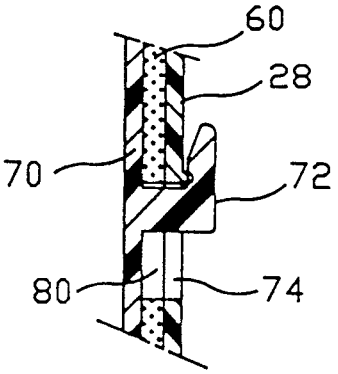
FIG. 5 is a partial sectional view along section lines 5—5 of FIG. 4, with some details omitted for clarity.
Figure 6:
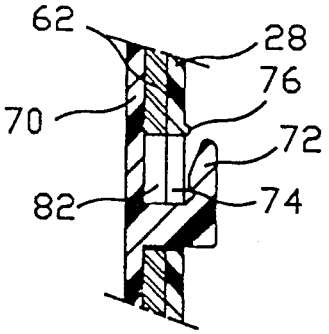
FIG. 6 is a view similar to FIG. 5, but with a portion of an element the Figure as shown being displaced to the left.
Figure 9:
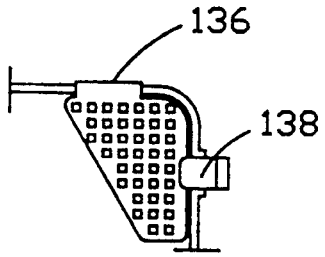
FIG. 9 is a top view of a portion of the debris collecting pan of FIG. 7 with the filter in a closed position.
Figure 7:
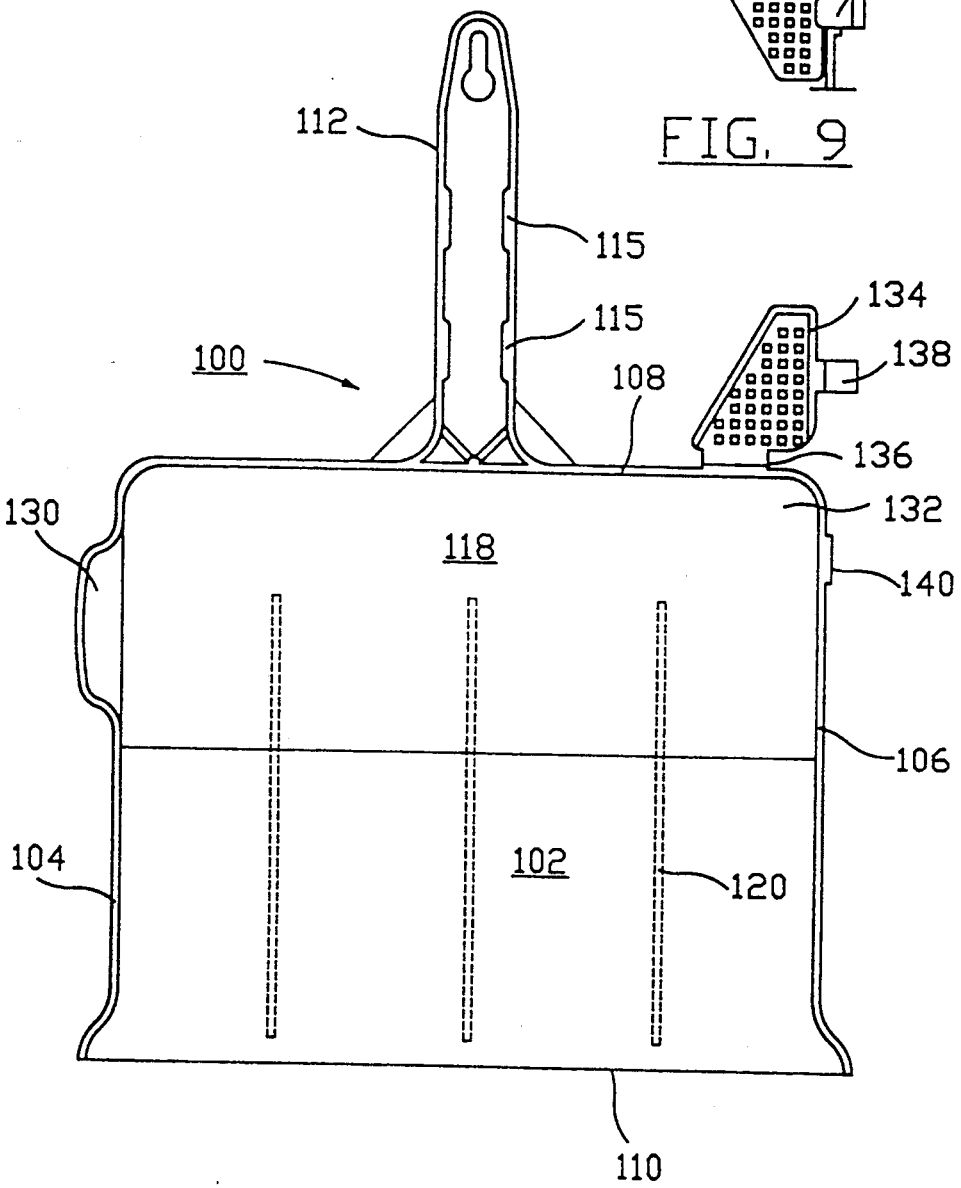
FIG. 7 is a top view of the debris collecting pan of the present invention.
Figure 8:
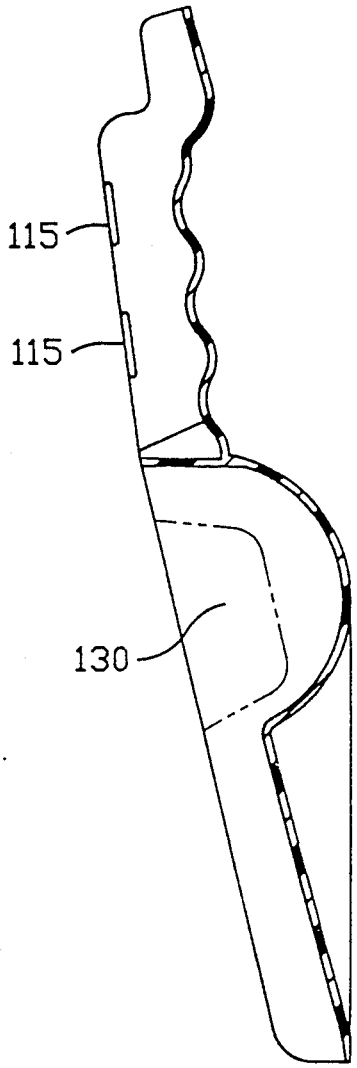
FIG. 8 is a sectional side view of the debris collecting pan of FIG. 7.
Figure 10:
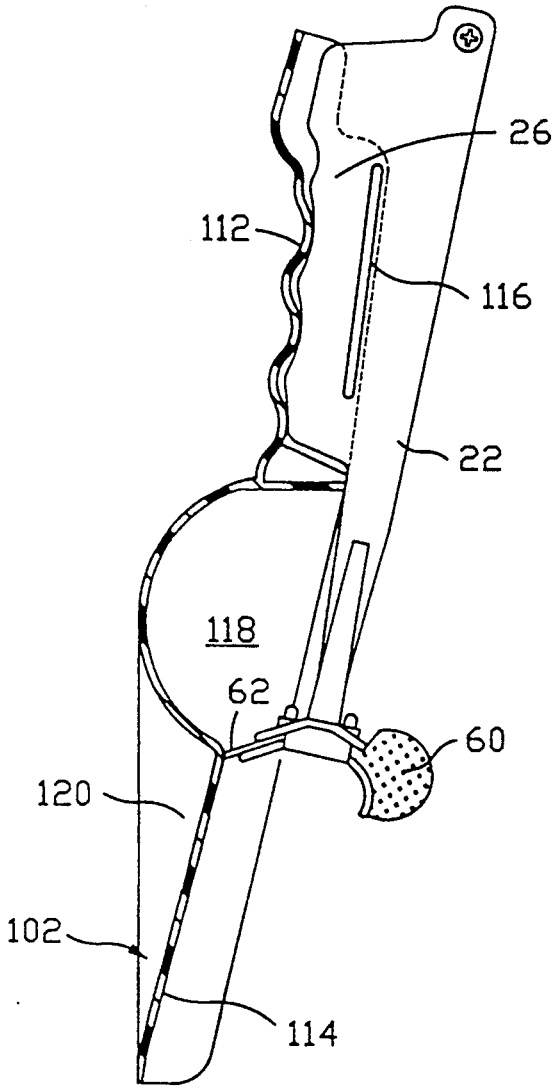
FIG. 10 is a side view of the multi-implement device of the present invention in a folded configuration, with the debris collecting pan attached to thereto.

The sponge 60 and the resilient blade 62 are securely retained on the head member 28 by a retaining member 70, which is adapted for releasable attachment to the head member 28 by a series of "L"-shaped clips 72 that extend from the retaining member 70. The "L"-shaped clips 72 are adapted to extend through co-operating apertures 74 in the head member 28 and are further adapted to be retained by cooperating projections 76 on the head member 28, as best seen in FIGS. 5 and 6.

The sponge 60 and the blade 62 each have a plurality of perforations 80, 82 therein that also receive the "L"-shaped clips therethrough, thus allowing the sponge 60 and the blade 62 to be retained on the head member in a set position. The head member 28 and the retaining member 70 are generally elongated so as to be roughly the same size as the sponge 60 and the resilient blade 62 thereby allowing the sponge 60 and the resilient blade 62 to be retained generally along their entire length. The head member 28 and the retaining member 70 have opposed receiving surfaces 84, 86 that are adapted to receive and retain a portion, preferably most or all, of the sponge 60 and the resilient blade 62 therebetween. The sponge 60 and the resilient blade 62 must be retained reasonably securely so as to help preclude tearing of the sponge 60 and the resilient blade 62 during use.

Figure 3:
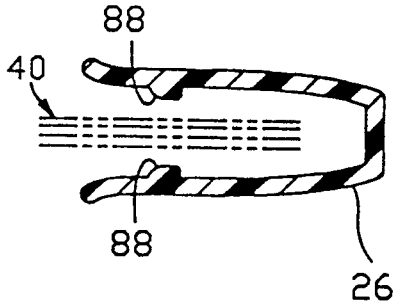
FIG. 3 is a sectional view along section line 3—3 of FIG. 1, with some details omitted for clarity.
Figure 4:
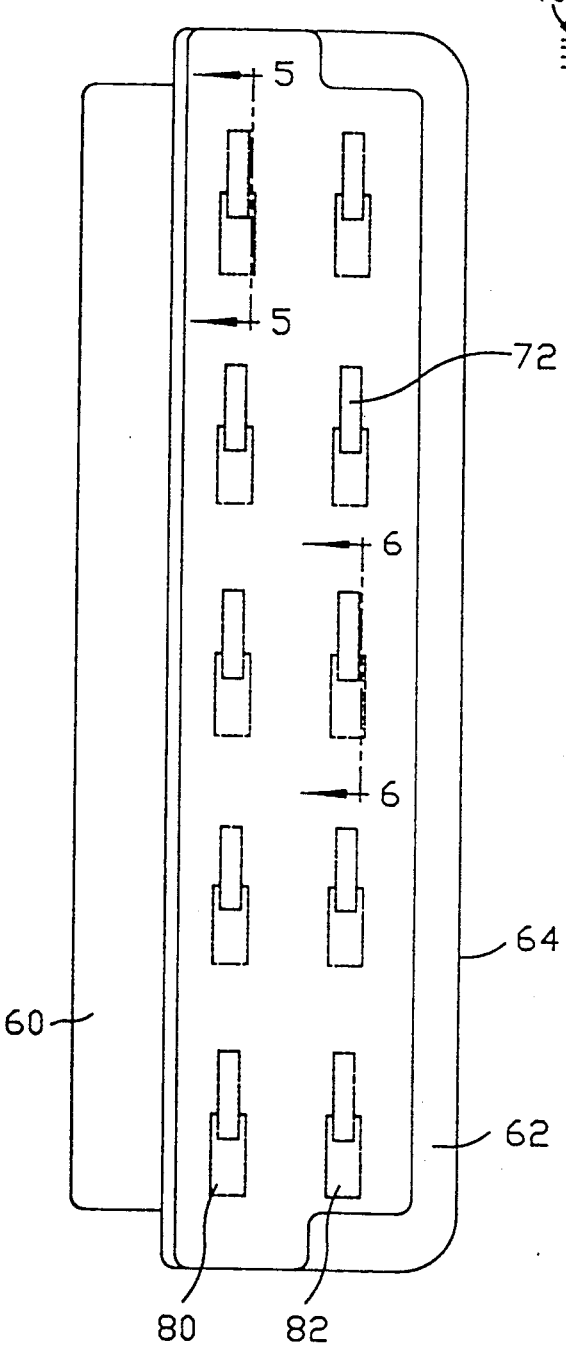
FIG. 4 is an end view of the multi-implement device of FIG. 1.

As can be best seen in FIG. 3, the hollow handle portion 26 of the main body member 22 is adapted to receive the bristles 40 of the brush 36, and has a pair of flanges 88 that are adapted to receive the lower surface 89 of the spine 38 of the brush 36.

Reference will now be made to FIGS. 7 through 10 which show a debris collecting pan 100 that has a debris receiving portion 102, a first side wall 104 and a second side wall 106, a back wall 108, a leading edge portion 110 and a handle portion 112. The handle portion 112 is adapted so as to clip onto the hollow handle portion 26 of the main body member 22. The handle portion 110 has two pairs of protrusions 115 that fit within an elongated slot 116 on the hollow handle portion 26 of the main body member 22.

The debris portion 102 has an upwardly sloping front portion 114 and a depression 118 at the rear thereof that forms a sump for retaining debris. There is a plurality of ribs 120 under the upwardly sloping front portion 114, which also extend partially under the depression 118. These ribs 120 are for supporting the upwardly sloping front portion 114 and the depression 118, and also to give the debris receiving portion 102 additional strength and rigidity.

In the first side wall 104 of the debris collecting pan 100 there is a first pouring spout 130. This first pouring spout 130 is used to pour debris from the sump 118. There is also a second filtered pouring spout 132 in the second side wall 106. The second pouring spout 132 has a filter cap 134 that is adapted for sealed fitment thereover. The cap 134 is attached to the debris collecting pan 100 by a living hinge 136. A tab 138 permits easy snap-on fitment of filter the cap 134 over lip 140.

In an alternative embodiment of the multi-implement device 20, it is envisioned that the brush could be telescopically extendible from the main body member.

In a further alternative embodiment, it is contemplated that the brush could be selectively dismountable and remountable on the main body member.

In yet a further alternative embodiment it is contemplated that the head member could be pivotably mountable so as to angle the sponge and resilient blade at a selected angle, and also to help make the multi-implement device more compact for storage.

Other modifications and alterations may be used in the design and manufacture of the household cleaning multi-implement devices of the present invention, without departing from the spirit and scope of the accompanying claims.

What is claimed is:

1. A device for effecting general household cleaning, comprising:

a main body member having a first longitudinal axis therealong, with a portion of said main body member having a generally hollow handle portion defining a storage area therein;

a head member affixed to a first end of said main body member, said head member having a second longitudinal axis;

a brush at a second end of said main body portion, and having an elongated spine and a plurality of bristles securely retained by said spine, said brush being connected in movable relation to said main body member and movable between an extended position and a retracted position;

a sponge securely retained on said head portion;

a resilient blade securely retained on said head portion and adapted for wiping liquid from a surface; and a retaining member secured to said head member by at least one clip which extends from said retaining member, whereby said retaining member is adapted for releasable attachment to said head member, and is further adapted to securely retain said sponge and said blade on said head member;

wherein said head and said retaining member are generally elongated and have opposed receiving surfaces adapted to receive and retain a portion of said sponge and said blade therebetween;

wherein a plurality of "L"-shaped clips are adapted to extend through co-operating apertures in said head member, and each of said clips is adapted to be retained by a co-operating projection on said head member; and wherein said brush is pivotably mounted by means of a pivot member having a pivot axis that is perpendicular to said first longitudinal axis and which is parallel to said second longitudinal axis, said brush being arcuately movable in a plane generally perpendicular to said pivot axis.

2. The device of claim 1, wherein said second longitudinal axis of said head member is perpendicular to the first longitudinal axis of said main body member.

3. The device of claim 1, wherein each of said sponge and said blade has a plurality of perforations therein so as to receive said plurality of "L"-shaped clips passed through said apertures, and so as to thereby be retained on said head member.

4. The device of claim 1, wherein said brush is selectively dismountable and re-mountable on said main body member.

5. A device for effecting general household cleaning, comprising:

a main body member having a first longitudinal axis therealong, with a portion of said main body member having a generally hollow handle portion defining a storage area therein;

a head member affixed to a first end of said main body member, said head member having a second longitudinal axis;

a brush at a second end of said main body portion, and having an elongated spine and a plurality of bristles securely retained by said spine, said brush being connected in movable relation to said main body member and movable between an extended position and a retracted position;

wherein said generally hollow handle portion is adapted to receive and retain said brush therein;

a sponge securely retained on said head portion;

a resilient blade securely retained on said head portion and adapted for wiping liquid from a surface; and a retaining member adapted for releasable attachment to said head member and further adapted to retain said sponge and said blade on said head member;

wherein said head and said retaining member are generally elongated and have opposed receiving surfaces adapted to receive and retain a portion of said sponge and said blade therebetween;

wherein said brush is pivotably mounted by means of a pivot member having a pivot axis that is perpendicular to said first longitudinal axis and which is parallel to said second longitudinal axis, said brush being arcuately movable in a plane generally perpendicular to said pivot axis;

wherein the arcuate motion of one end of said brush is limited by a stop means on said main body member, which stop means comes in contact with a stop member on said one end of said brush; and wherein said spine has a longitudinal extension that is disposed on the opposite side of said pivot axis to said bristles, and said stop means contacts said longitudinal extension.

6. A device for effecting general household cleaning, comprising:

a main body member having a first longitudinal axis therealong, with a portion of said main body member having a generally hollow handle portion defining a storage area therein;

a head member affixed to a first end of said main body member, said head member having a second longitudinal axis;

a brush at a second end of said main body portion, and having an elongated spine and a plurality of bristles securely retained by said spine, said brush being connected in movable relation to said main body member and movable between an extended position and a retracted position;

a sponge securely retained on said head portion;

a resilient blade securely retained on said head portion and adapted for wiping liquid from a surface; and a retaining member adapted for releasable attachment to said head member and further adapted to securely retain said sponge and said blade on said head member;

wherein said head and said retaining member are generally elongated and have opposed receiving surfaces adapted to receive and retain a portion of said sponge and said blade therebetween; and wherein said brush is pivotably mounted by means of a pivot member having a pivot axis that is perpendicular to said first longitudinal axis and which is parallel to said second longitudinal axis, said brush being arcuately movable in a plane generally perpendicular to said pivot axis;

wherein said device further comprises a debris collecting pan removably attached to said main body member, said debris collecting pan having a debris receiving portion, first and second side walls, a back wall, a leading edge portion, and a handle portion;

wherein said handle portion of said debris collecting pan is adapted to as to clip onto said hollow handle portion of said main body portion;

wherein said debris receiving portion has an upwardly sloping front portion supported by a plurality of ribs thereunder, and a depression at the rear thereof so as to form a sump for retaining debris;

wherein said debris collecting pan has a first pouring spout at one side in said first side wall; and wherein said debris collecting pan has a second pouring spout in said second side wall.

7. The device of claim 6, wherein said second filtered pouring spout has a cap adapted for sealed fitment thereover and attached to said pan by a living hinge.

* * * * *